United States Patent [19]

Taylor

[11] Patent Number: 4,844,157

[45] Date of Patent: Jul. 4, 1989

[54] JAR ACCELERATOR

[76] Inventor: William T. Taylor, P.O. Box 309, Warren, Tex. 77664

[21] Appl. No.: 217,447

[22] Filed: Jul. 11, 1988

[51] Int. Cl.[4] ..... E21B 4/06; E21B 31/107

[52] U.S. Cl. ..... 166/178; 175/299; 175/302

[58] Field of Search ..... 166/178; 175/293, 299, 175/300, 302, 303; 267/162, 125

[56] References Cited

U.S. PATENT DOCUMENTS

| | | | |
|---|---|---|---|
| 2,122,751 | 7/1938 | Phipps | 175/300 |
| 2,144,869 | 1/1939 | Boulter | 175/300 |
| 2,417,715 | 3/1947 | Stewart | 267/162 |
| 2,882,018 | 4/1959 | Andrew | 175/299 |
| 3,406,770 | 10/1968 | Arterbury et al. | 175/299 |
| 3,472,326 | 10/1969 | Sutliff et al. | 175/299 |
| 3,539,026 | 11/1970 | Sutliff et al. | 175/299 |
| 3,735,828 | 5/1973 | Berryman | 175/299 |
| 3,873,079 | 3/1975 | Kuus | 267/162 |
| 4,333,542 | 6/1982 | Taylor | 175/299 |

*Primary Examiner*—Bruce M. Kisliuk

*Attorney, Agent, or Firm*—J. Peppers

[57] ABSTRACT

A jar accelerator including an elongated tubular tool body and an elongated mandrel axially slidingly mounted within the tool body and having an outwardly facing shoulder. A composite plurality of frusto-conical disc springs are disposed inside the tool body about the mandrel and between the shoulders to provide a preselected accelerating function.

12 Claims, 2 Drawing Sheets

JAR ACCELERATOR

FIELD OF THE INVENTION

The present invention relates generally to fishing apparatus utilized within a well bore to free stuck pipe or tools. More specifically, the present invention relates to an accelerator for use with a jar having a operating stroke between a set position and an impact position, and a force responsive jar latch that maintains the jar in the set position until a preselected tension force is applied thereto.

DESCRIPTION OF THE PRIOR ART

During the drilling and completion of deep wells, such as wells for producing petroleum products, objects such as drill pipe, well tools and other apparatus sometimes become stuck within the well bore and cannot be removed by the application of ordinary upward forces. In such cases, it is necessary to delivery sharp jarring forces to the stuck object in order to free it for extraction from the well bore. Apparatus have been developed for delivering such jarring forces and are known as jars.

Jars generally include a body structure that is attached to the stuck object and a mandrel slidingly mounted in the body structure, that is attached to the surface through pipe or wire. The body structure has an anvil and the mandrel has a hammer. Means for provided for releasably connecting the mandrel and body together to hold the anvil and hammer in spaced apart relationship, the distance of such spacing being known as the "stroke" of the jar. The releasable connection means are adapted to release when the tension over the jar exceeds a certain level. When the connection means releases, the hammer is free to travel upwardly to strike the anvil.

In order for the mandrel to move upwardly upon the release of the connection means, there must be stored rebound energy in the string of pipe or wire connected between the surface and the mandrel. Typically, the stored rebound energy is spread throughout the system and includes pipe stretch, wire stretch in the hoisting gear, and some compression of the derrick.

There are several limitations upon the efficiency of jars. For example, in deviated or crooked holes, direction of the pipe or wire against the wall of the hole reduces the speed at which the stored stretch energy is delivered to the jar upon release of the connection means, which reduces the jarring forces. Also, at shallow depths, there is only a small length of pipe or wire over which rebound energy may be stored. Thus, at shallow depths, the effectiveness of jars is limited.

In an effort to improve the efficiency of jars, there have been developed a number of devices known variously as accelerators, jar boosters, or intensifiers. The primary function of such devices is to store the rebound energy in the device, which is inserted in the string immediately above the jars and drill collars or sinker bars, rather than in the pipe or wire.

One such device is made by Bowen Tools and is shown generally in the 1984–85 Composite Catalog at pages 1061–1062. Another such device is manufactured by Johnston and is shown generally in the 1984–85 Composite Catalog at page 2981.

Two examples of such apparatus are disclosed in Suttliff et al., U.S. Pats. Nos. 3,472,326 and 3,539,026. The first Suttliff reference uses a coil spring for energy storage which can cause the accelerator tool to be extremely long and cumbersome. The second Suttliff reference uses dished washer springs similar to the present invention. This reduces the length required but has a major drawback in that when the tool is used with variable release tension jars, it must be physically dismantled and the springs rearranged whereas the present invention is "selfadjusting", and does not require disassembly.

For reference to the use of spring discs in cartridges see Kucks, U.S. Pat. No. 3,873,079. While the concept is similar to that used in Suttliff U.S. Pat. No. 3,539,026 and the present invention, many modifications are necessary for use as an accelerator as evidenced by the present invention.

Other known prior art include U.S. Pat. Nos. 4,333,542, 3,735,828 and 2,417,715.

It is the principal object of the present invention to overcome the shortcomings of the prior art.

SUMMARY OF THE INVENTION

Briefly stated, the foregoing and other objects are accomplished by the jar accelerator of the present invention which includes a tubular tool body and an elongated mandrel axially slidingly mounted within the tool body. The tool body has an internal shoulder and the mandrel has an outwardly facing shoulder which shoulders together define an internal spring chamber between the mandrel and the body. A plurality of frustoconical disc springs are stacked about the mandrel within the spring chamber. Means are provided for maintaining the pressure within the spring chamber at substantially the same level as the pressure outside the tool body throughout the operation of the jar accelerator.

The disc springs are selected and arranged with intermediate flat spacers to provide a composite spring constant such that compression of the plurality of disc springs over a length greater than the stroke of the jar with which the jar accelerator of the present invention is used, generates a force less than the force required to release the connection means of the jar. Stated in another way, the disc springs are selected and arranged such that during operation the accelerator will elongate more than the stroke of the jar, whereby substantially all of the movement during the stroke of the jar is supplied by the accelerator.

In one aspect of the invention, the plurality of disc springs includes a first set having a length of compression at least as long as the stroke of the jars and a total spring constant such that the force developed over the length of the compression is less than the force required to release the jars, and a second set of disc springs having a composite spring constant larger than that of the first set.

DESCRIPTION OF A PREFERRED EMBODIMENT

Figure 1:
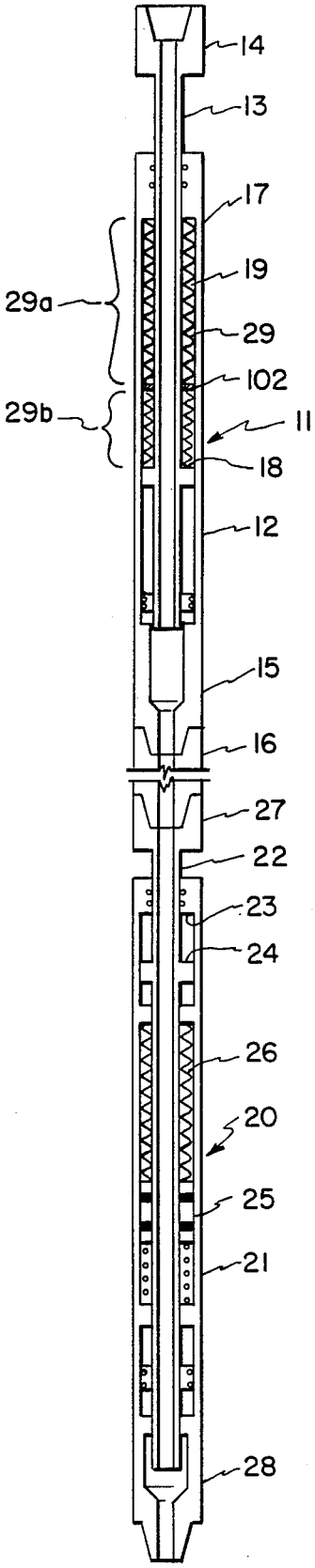
FIGS. 1, 2 and 3 are schematic sectional elevational views of the jar accelerator of the present invention as connected above a well pipe jar.
Figure 2:
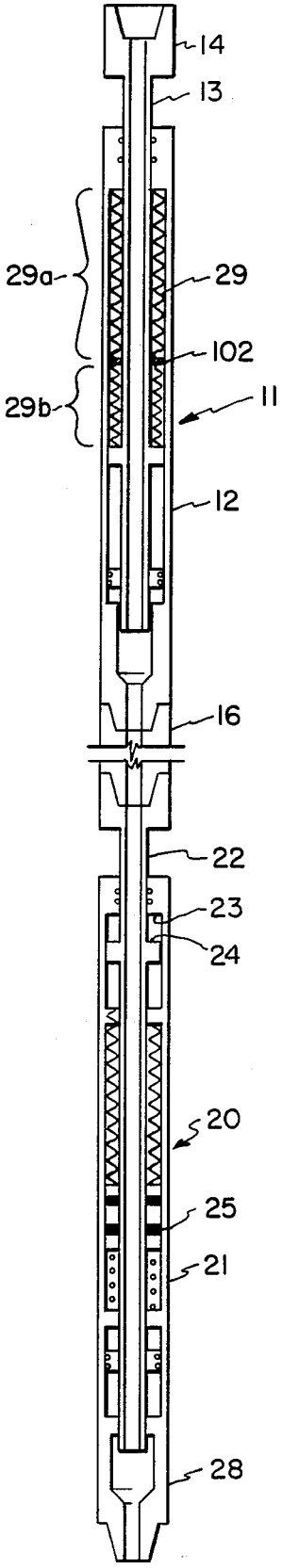
Figure 3:
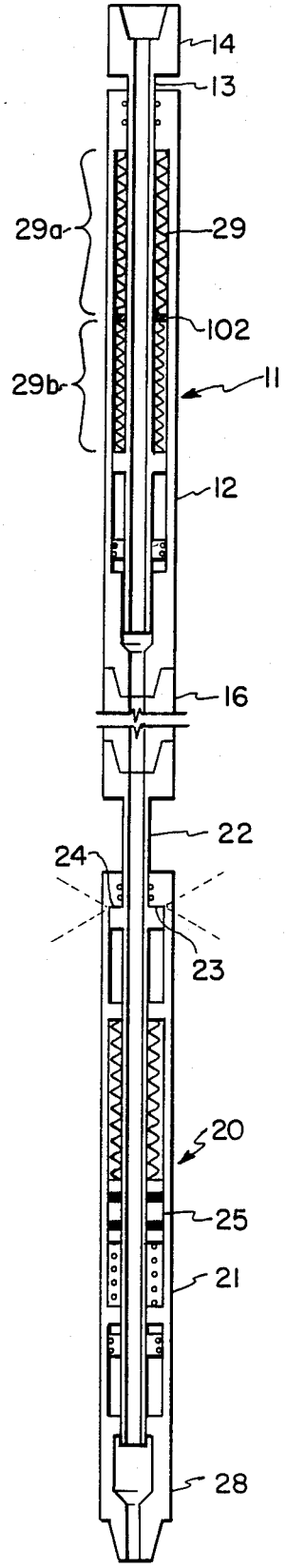

Referring now to the drawings, the first to FIGS. 1–3, the jar accelerator of the present invention is designated generally by the numeral 11. Accelerator 11 includes a tubular tool body 12 and a tubular mandrel 13 axially slidingly mounted in tool body 12. Mandrel 13 has at its upper end a tool connection 14 which is adapted to connect with drill pipe or other tool support means. The lower end of tool body 12 is formed to define a tool connection 15 which is adapted to connect with weighting means, as for example drill collars 16 or sinker bars.

Jar accelerator 11 is adapted for use with a limited upstroke jar designated generally by the numeral 20. Jar 20 is preferably a mechanical jar of the type disclosed in U.S. Pat. No. 4,333, 542; however, jar accelerator 11 may be used with other limited upstroke jars including oil jars.

Jar 20 includes an elongated body 21 and an elongated operator mandrel 22. Jar body 21 is formed to define an internal anvil 23 and operator mandrel 22 is formed to define a hammer 24. Jar 20 includes a latch 25 which establishes a releasable When jar body 21 and operator mandrel 22 are latched together, anvil 23 and hammer 24 are spaced apart a distance as shown in FIG. 1. This distance is known as the "stroke" of the jar. latch 25 is releasable when the axial tension between jar body 21 and operator mandrel 22 exceeds a certain level. Spring means 26 are provided for setting the level of tension of which latch 25 releases.

Operator mandrel 22 of jar 20 includes at its upper end a tool connection 27 which is adapted to connect with drill collars 16. Jar body 21 includes at its lower end a tool connection 28 which is adapted to connect with a fishing tool, if jar 20 is used as a fish jar, or with drill collars if jar 20 is used as a drilling jar.

Tool body of jar accelerator 11 is formed to define an internal shoulder 17 and jar accelerator mandrel 13 is formed to define a facing shoulder 18. Shoulders 17 and 18 cooperate to form a spring chamber 19 which contains a stack of frusto-conical disc springs 29. Disc springs 29 urge shoulders 17 and 18 apart.

Referring now to FIG. **4*b*, the stack of frusto-conical springs is shown in partial cross-section to illustrate the components. The stack includes frusto-conical disc springs of various thicknesses, indicated at 100 and 101 and flat spacer washers 102** spaced at intervals in the stack to provide the selected composite spring constant more fully described hereinbelow.

In FIG. 1, jar 20 is shown immediately prior to the release of latch 25. Spring means 26 of jar 20 is compressed to develop a force slightly less than the set force of the latch. Disc springs 29 of jar accelerator 11 are compressed by the movement together of shoulders 17 and 18. The compression of disc springs 29 stores energy, which upon release of latch 25 is delivered to drill collars 16 and jar 20. Disc springs 29 are selected and arranged to have a composite spring constant such that the elongation of jar accelerator 11 during loading is greater than the stroke of jar 20.

Referring specifically to FIG. 2, jar 20 is shown at an instant after the release of latch 25. When latch 25 is released, jar body 21 and operator mandrel 22 are free to move axially with respect to each other thereby allowing hammer 24 to move toward anvil 23. The force causing the movement of hammer 24 toward anvil 23 is provided by jar accelerator 11. The energy stored in disc springs 29 is delivered to drill collars 26 and operator mandrel 22, drill collars 16 and accelerator tool body 12, which are substantially rigidly interconnected, accelerate rapidly upward as a unit and the potential energy stored in springs 29 is converted into kinetic energy.

In FIG. 3, jar 20 is shown at the instant of impact between hammer 24 and anvil 23. The impact between hammer 24 and anvil 23 brings the movement of drill collars 16 and accelerator tool body 12 to a substantially instantaneous stop, which in turn delivers a tremendous impulse through lower jar tool connection 28 to the stuck object. As shown in FIG. 3, jar accelerator 11 is still in a slightly elongated position and disc springs 29 are still slightly compressed. Thus, at all times prior to impact, jar accelerator 11 provides acceleration to drill collars 16 and jar operator mandrel 22.

Referring now to FIGS. **4*a*, 4*b* and 4*c* along with FIGS. 1–3, there is shown the preferred embodiment of jar accelerator 11. Accelerator tool body 12 includes an upper body 30 which is threadedly connected to an upper middle body 35. Upper middle body 35 in turn is threadedly connected to a lower middle body 40. Lower middle body 40 in turn is threadedly connected to a lower body 45 which includes tool connection 15. Upper body 30, upper middle body 35, lower middle body 40 and lower body 45 thus forms a unitary body and appropriate double O-ring seals, as for example seals 31 and 36 at the threaded inner connection between upper body 30 and upper middle body 35, are provided at all of the threaded inner connections between the portions of body 12 as shown, thereby making body 12** fluid tight.

Accelerator mandrel 13 includes an upper portion 50, which includes upper tool connection 14 and lower portion 60. Upper mandrel portion 50 and lower mandrel portion 60 are threadedly connected together by a connector 62. Appropriate seals, as for example seal 63, are provided for sealing the interconnections between upper mandrel portion 50 and lower mandrel portion 60 with connector 62, thereby making the unitary mandrel 13 fluid tight.

Shoulder 17 of body 12 is formed by the lower end of upper middle body 35 and a spring load ring 37 disposed between lower middle body 40 and lower mandrel portion 60. Lower shoulder 18 is formed by an adjusting nut 61 which is engaged with an elongated threaded portion 64 on lower mandrel portion 60. A lock nut 65 is provided for locking in position and preventing axial movement of adjusting nut 61. Spring chamber 19 thus includes the annular space between lower mandrel portion 60 and lower middle body 40 which is axially bounded by spring load ring 37 at one and an adjusting nut 61 at the other.

Disc springs 29 includes a first upper set of relatively stiff disc springs **29*a* and a second lower set of relatively less stiff disc springs 29*b*. The respective numbers and stiffnesses of the disc springs of sets 29*a* and 29*b*, are selected in accordance with the stroke and latch release load characteristics of the jar with which jar accelerator 11 is used. More specifically, the disc springs of second lower set 29*b* are selected so as to have a composite spring constant and length such that compression of second tower set 29*b* over a distance equal to the stroke of the jar produces a force less than the latch release load of the jar. Stated in another way, the length and composite spring constant of second lower set 29*b* allows the elongation of mandrel 13 with respect to accelerator tool body 12** during operation to be greater than the stroke of the jar.

The first upper set of springs 29*a* is formed to have a greater composite spring constant than that of the second lower set of springs 29*b*. The composite of springs 29 thus cause accelerator 11 to have a progressive spring characteristic in which a first portion of elongation accelerator 11 (compression of disc springs 29) by a length equal to the stroke of the jar is provided by second lower set of springs 29*b* and provides a force less than the force required to release the jar. A second portion of elongation of accelerator 11 is provided by compressing first upper set of springs 29a over a relatively small distance to produce a force necessary to release the jar.

The progressive spring characteristic feature of the present invention is particularly advantageous in situations where a premium is placed upon length and the jar is setable over a wide range of release forces. In such situations, the second lower set of springs 29*b* is selected such that elongation of accelerator 11 over a length equal to the stroke of the jar produces a force less than the minimum release setting. The first upper set of springs 29*a* is selected such that relatively small additional elongation of accelerator 11 produces sufficient additional force to release the jar at the highest setting. Thus, the progressive spring characteristic of accelerator 11 allows the length of disc springs 29 to be minimized while at the same time insuring that the elongation of accelerator 11 will always exceed the stroke of the jar.

Different configurations of disc springs 29 may be accomodated by changing the position of adjusting nut 61 upon threaded portion 64.

Figure 4A:
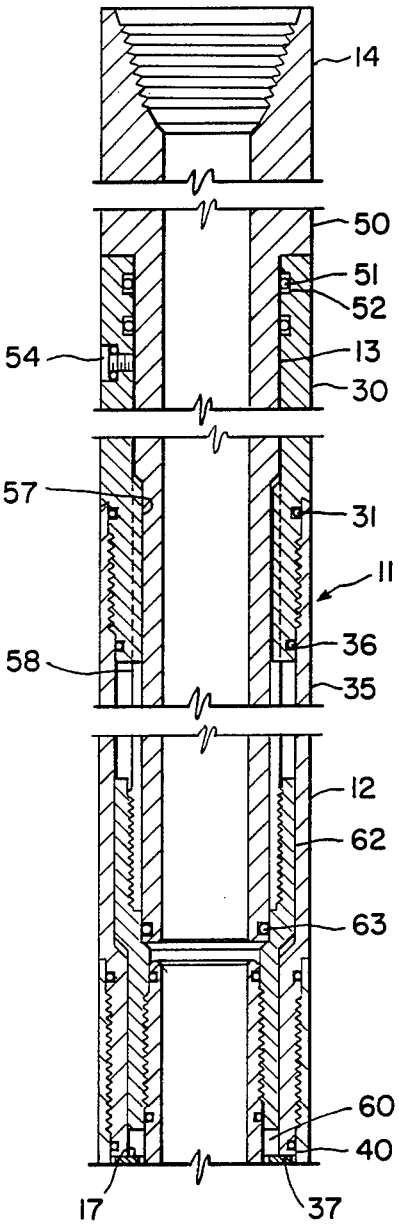
FIGS. 4*a*, 4*b* and 4*c* are sectional elevational views, respectively, of the upper, central and lower portions of the jar accelerator.
Figure 4B:
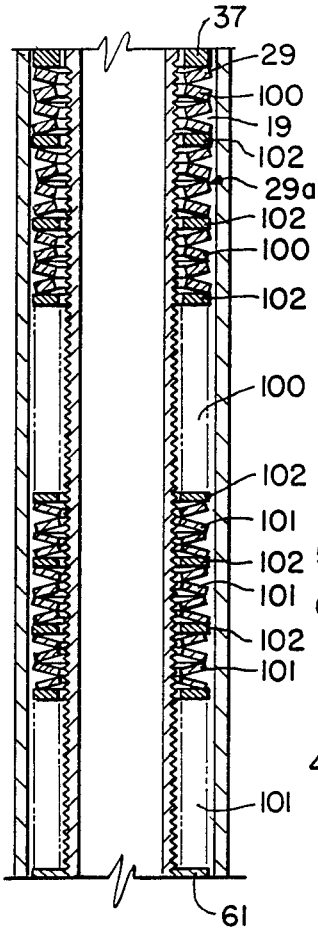
Figure 4C:
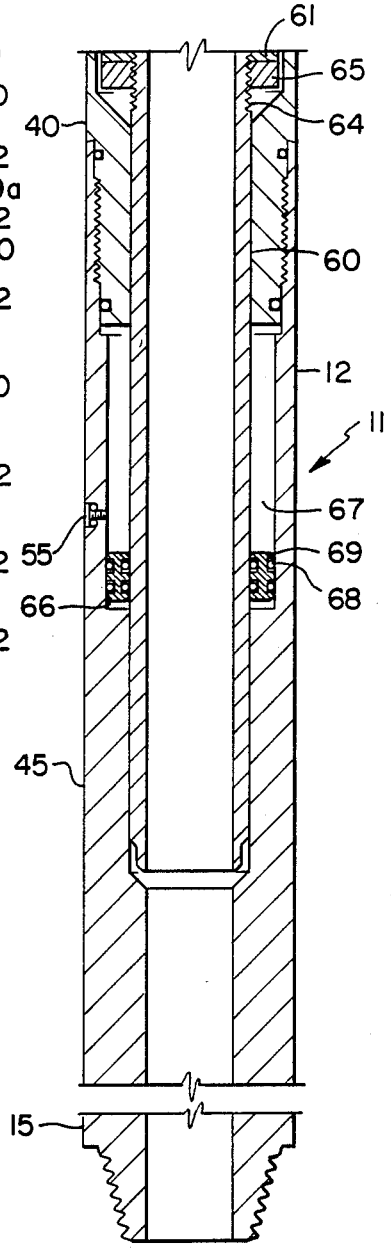

In one embodiment of the invention as shown in FIG. 4*b* the set of springs 29*a* comprises a subset of heavy disc springs, 100, another spacer 102, and further subsets of heavy disc springs 100 with each subset being separated by a spacer 102; the lower set of springs 29*b* comprises subsets of light disc springs 101, another spacer 102, and another subset of light disc springs 101. This arrangement allows for an eight inch maximum stroke of mandrel 13 at a load of 50,000 pounds. This accelerator may be used with a variable release jar without disassembling the accelerator or replacing the disc springs. The accelerator in this particular configuration, will always have a mandrel stroke in excess of the stroke of the jar no matter what the release pressure of the jar is.

The advantages of this particular selection is that when the jar with which the accelerator is to be used has an adjustable jar force, the use of the present invention does not require disassembly as specifically disclosed in Suttliff U.S. Pat. No. 3,539,026. The accelerator is responsive over a range of adjustments and the accelerator is specifically selected to operate with a specific jar. In the alternative, the spring constant in the accelerator can be adjusted by the nut 61 to accommodate the range of adjustment of the jar.

The operation of the jar as explained in conjunction with FIGS. 1–3 is such that the stroke of the jar 20 is accommodated by the lower set of springs 29*b* in stroke of the mandrel 13 (FIG. 1). The upper set of springs 29*a* then absorbs up to the maximum setable force of the jar 20 in additional "stroke" of the mandrel 13 which is less than the "stroke" of the jar 20 (FIG. 2). There is therefore a "stroke" of the mandrel 13 which is greater than "stroke" of the jar 20. When the jar 20 releases upward, there is now force holding down against the springs 29*a* and 29*b* allowing them to release downward the length of the stroke of the mandrel 13 in the accelerator 11. This momentarily isolates the upward force of the jar 20 from the drill string allowing the jar 20 to exert a maximum force upward against the fishing tool (not shown).

Unless the two sets of springs are selected as described, the described function will not be achieved. The selected springs constants allow use of an accelerator over a range of force settings on a given jar.

The space between accelerator tool body 12 and accelerator mandrel 13, including spring chamber 19, is preferably filled with a lubricating oil. A set of upper mandrel seals, including seal 51, is provided for forming a sliding seal between upper body 30 and upper mandrel portion 50 to isolate the lubricating oil from the outside environment of accelerator 11. Also included on either side of seal 51 is a pair of protector rings, including protector ring 52.

The other end of accelerator 11 is sealed by a free piston 66 which is slidingly mounted between lower mandrel portion 60 and lower body 45 in a reservoir 67. Free piston 66 is sealingly engaged with both lower mandrel portion 60 and lower body 45 by a set of seals and protector rings including seal 60 and protector ring 69. Free piston 66 is freely movable thereby to accommodate volumetric changes in the lubricating oil during operation of accelerator 11. Also, free piston 66 balances the pressure on both sides thereof, thereby to keep the pressure of the lubricating oil between accelerator tool body 12 and mandrel 13, including that within spring chamber 19, at a level substantially equal to ambient pressure.

Since accelerator 11 operates in a pressure balanced condition, the failure of any or all of the seals will not affect the operation of accelerator 11. Seal failure can only cause contamination or loss of lubricating oil but will not disable the tool. Fill plugs 54 and 55 are provided for filling accelerator 11 with lubricating oil. In certain embodiments, the seals and lubricating oil may be omitted so that spring chamber 19 may communicate directly with the well bore.

In order that torque may be transmitted across accelerator 11, upper body 30 and upper mandrel portion 50 have cooperating splines 57 and 58 respectively. The splines enable accelerator 11 to be used with drilling jars.

From the foregoing it will be seen that this invention is one well adapted to attain all of the ends and objects hereinabove set forth together with other advantages which are obvious and which are inherent to the apparatus.

It will be understood that certain features and subcombinations are of utility and may be employed with reference to other features and subcombinations. This is contemplated by and is within the scope of the claims.

Since many possible embodiments may be made of the invention without departing from the scope thereof, it is to be understood that all matters herein set forth are shown in the accompanying drawings as to be interpreted as illustrative and not in a limiting sense. The purview of the invention is specified in the appended claims.

That being claimed is:

1. A jar accelerator adapted for use with a jar having force responsive release means, comprising:

(a) an elongated tubular body having an inwardly facing shoulder;

(b) an elongated mandrel slidingly mounted within said tubular body and having an outwardly facing shoulder axially fixed thereto, said shoulders defining an internal spring chamber between said mandrel and said body;

(c) a plurality of frusto-conical disc springs and flat spacers disposed as an array within said internal spring chamber;

(d) said array of disc springs and flat spacers including a first set of disc springs and a second set of disc springs;

(e) said second set of disc springs and flat spacers disposed such that the second length of compression of said second set is at least as long as the stroke of said jar and has a second spring constant such that the force developed over said second length of compression is less than the minimum force required to release said jar; and (f) said first set of disc springs and flat spacers disposed such that the spring constant of said first set is greater than the spring constant of said second set; and (g) a composite spring constant of said second set and of said first set being such that a force greater than the maximum force required to release said jar is developed in a composite length of compression of said first set and said second set.

2. The apparatus of claim 1 including means for maintaining the pressure inside the said internal spring chamber substantially equal to the pressure exterior of said tool body, said means including a slidable piston sealingly disposed about said mandrel and within said tool body.

3. The apparatus of claim 2 wherein said internal spring chamber is filled with a substantially incompressible fluid.

4. The apparatus of claim 3 including means for compensating for changes of volume of said internal spring chamber, and balancing the pressure of said fluid filling said internal spring chamber and the pressure exterior of said tool body during operation of said accelerator, said compensating and balancing means including closure means received in movable relationship between said mandrel and said tool body, said closure means including a piston movably disposed between said mandrel and said tool body and means for forming a seal with both said mandrel and said tool body.

5. The apparatus of claim 2 including means for transmitting torque between said mandrel and said tool body.

6. The apparatus of claim 1 including means for changing the spacing between said shoulders to accommodate different lengths of sets of disc springs.

7. The apparatus of claim 1 including means for slidingly sealing between said tool body and said mandrel at axially opposite ends of said internal spring chamber, a substantially incompressible fluid filling the space between said sealing means inside tool body and outside said mandrel.

8. The apparatus of claim 7 including means for maintaining the pressure of said incompressible fluid substantially constant during the operating of said accelerator.

9. The apparatus of claim 8 including means for balancing the pressure of said fluid with the pressure exterior of said seal means, said pressure balancing means including piston means having one end exposed to pressure exterior of said seals.

10. The apparatus of claim 2 wherein said internal spring chamber is filled with a substantially incompressible fluid and including means for transmitting torque between said mandrel and said body.

11. A jar accelerator apparatus for use with a well jar which is released upon an axial force to deliver an upward impact force in response to rapid upward movement of a jar hammer against a jar anvil within the jar, said apparatus comprising:

(a) an elongated tubular body having an inwardly facing body shoulder;

(b) an elongated mandrel having an outwardly facing mandrel shoulder slidingly mounted within said body;

(c) said body, said body shoulder, said mandrel, and said mandrel shoulder forming a spring chamber;

(d) a first set of disc springs disposed within said chamber;

(e) a second set of disc springs disposed within said chamber;

(f) said first set of disc springs having a spring constant such that said first set becomes fully compressed responsive to a force greater than the force required to release said jar;

(g) said second set of disc springs having a spring constant such that said second set becomes fully compressed responsive to a force less than the force required to release said jar and having a length of compression at least as long as the stroke of said jar;

(h) said first set and said second set of disc springs having a composite spring constant such that a composite force required to release said jar is developed over less length than the composite length of compression of said first set and said second set.

12. The apparatus of claim 11 further including means for changing the spacing between said shoulders to accommodate sets of springs of different total length.

* * * * *